US008820019B2

(12) United States Patent
Belanger

(10) Patent No.: US 8,820,019 B2
(45) Date of Patent: Sep. 2, 2014

(54) SUSPENDED CEILING SYSTEM AND FOLDABLE RUNNER THEREFORE

(75) Inventor: Alain Belanger, Kedgwick (CA)

(73) Assignee: Corruven Canada Inc., New Brunswick (CA)

( * ) Notice: Subject to any disclaimer, the term of this patent is extended or adjusted under 35 U.S.C. 154(b) by 0 days.

(21) Appl. No.: 13/638,012

(22) PCT Filed: Mar. 29, 2011

(86) PCT No.: PCT/CA2011/050163
§ 371 (c)(1),
(2), (4) Date: Sep. 28, 2012

(87) PCT Pub. No.: WO2011/120160
PCT Pub. Date: Oct. 6, 2011

(65) Prior Publication Data

US 2013/0014461 A1 Jan. 17, 2013

(30) Foreign Application Priority Data

Mar. 30, 2010 (CA) ..... 2698081

(51) Int. Cl.
*E04B 9/20* (2006.01)

(52) U.S. Cl.
USPC ..... 52/506.07; 52/69; 52/745.19

(58) Field of Classification Search
USPC ..... 52/506.07, 281, 483.1, 69, 71, 836, 52/846, 847, 65.1, 848, FOR. 145
See application file for complete search history.

(56) References Cited

U.S. PATENT DOCUMENTS

| | | | | | |
|---|---|---|---|---|---|
| 2,382,456 | A | * | 8/1945 | Urbain | 52/509 |
| 3,246,432 | A | | 4/1966 | Young, Jr | |
| 3,263,388 | A | * | 8/1966 | Bogert | 52/665 |
| 3,356,402 | A | * | 12/1967 | Smith | 403/219 |
| 3,583,119 | A | | 6/1971 | Kann | |
| 3,785,110 | A | * | 1/1974 | Galloway et al. | 52/715 |
| 3,798,865 | A | * | 3/1974 | Curtis | 52/665 |
| 3,848,385 | A | * | 11/1974 | Thompson | 52/506.06 |
| 3,927,438 | A | | 12/1975 | Blake | |
| 4,055,930 | A | * | 11/1977 | Weinar et al. | 52/718.01 |
| 4,057,947 | A | | 11/1977 | Oide | |

(Continued)

FOREIGN PATENT DOCUMENTS

| | | |
|---|---|---|
| CA | 2617377 | 2/2007 |
| CA | 2570094 | 6/2008 |

(Continued)

OTHER PUBLICATIONS

Intl. Search Rpt., CA, Jul. 5, 2011, Corruven Canada Inc.

(Continued)

*Primary Examiner* — Robert Canfield
*Assistant Examiner* — Babajide Demuren
(74) *Attorney, Agent, or Firm* — GrayRobinson, P.A.

(57) ABSTRACT

A runner, a suspended ceiling system, and a method of installing a suspended ceiling, the runner having a base with two laterally opposite flanges for supporting ceiling tiles, a hinged web connected to the base between the flanges so as to be foldable between a flat configuration with the web folded against one of the flanges and an inverted-T configuration with the web normal to the base for suspension and use, the hinged web allowing for economies is shipping when compared to conventional rigid inversed-T shaped runners.

4 Claims, 8 Drawing Sheets

(56) References Cited

U.S. PATENT DOCUMENTS

| | | | | | |
|---|---|---|---|---|---|
| 4,121,386 | A | | 10/1978 | Perez | |
| 4,428,993 | A | | 1/1984 | Konh et al. | |
| 4,570,391 | A | * | 2/1986 | Quante et al. | 52/39 |
| 4,580,387 | A | * | 4/1986 | Rogers | 52/665 |
| 4,722,161 | A | | 2/1988 | Young | |
| 4,773,200 | A | | 9/1988 | Young | |
| 5,218,808 | A | | 6/1993 | Ardley | |
| 5,239,801 | A | | 8/1993 | Adams | |
| 5,279,090 | A | * | 1/1994 | Yamaguchi et al. | 52/506.08 |
| 5,325,647 | A | * | 7/1994 | Forry et al. | 52/309.15 |
| 5,379,786 | A | * | 1/1995 | Lynam | 135/87 |
| 5,457,925 | A | | 10/1995 | Koedyker | |
| 5,495,697 | A | | 3/1996 | Bischel et al. | |
| 5,609,007 | A | * | 3/1997 | Eichner | 52/747.1 |
| 5,619,833 | A | | 4/1997 | Neff | |
| 5,948,198 | A | | 9/1999 | Blyt | |
| 6,493,898 | B1 | | 12/2002 | Woods et al. | |
| 6,715,188 | B1 | | 4/2004 | Jackson et al. | |
| 6,990,777 | B2 | | 1/2006 | Poliacek et al. | |
| 7,269,927 | B2 | | 9/2007 | Savard | |
| 2003/0154679 | A1 | * | 8/2003 | Swiszcz et al. | 52/506.07 |
| 2005/0241267 | A1 | | 11/2005 | Wu | |
| 2006/0260245 | A1 | | 11/2006 | Schoolcraft | |

FOREIGN PATENT DOCUMENTS

| | | |
|---|---|---|
| FR | 918265 | 2/1947 |
| FR | 1093518 | 5/1955 |
| GB | 532724 | 1/1941 |
| GB | 1360105 | 7/1974 |
| GB | 2453358 | 8/2009 |
| WO | 9963180 | 12/1999 |
| WO | 2008067662 | 6/2008 |
| WO | 2011120160 | 10/2011 |

OTHER PUBLICATIONS

Written Opinion, CA, Jul. 5, 2011, Corruven Canada Inc.

* cited by examiner

SUSPENDED CEILING SYSTEM AND FOLDABLE RUNNER THEREFORE

CROSS-REFERENCE TO RELATED APPLICATIONS

This application is a national phase entry of international application no. PCT/CA2011/050163 filed 29 Mar. 2011 under the Patent Cooperation Treaty, which claimed priority of Canadian patent application no. 2,698,081, filed 30 Mar. 2010.

BACKGROUND

Suspended ceilings in general are well known. They consisted of a framework or grid of brackets referred to as runners and typically having a rigid inversed-T shape cross-section, which were suspended from a structure above, and which was used in supporting an array of ceiling tiles. Typically, runners oriented in a given longitudinal orientation were manufactured in a length substantially longer than runners oriented in a transversal orientation, the latter being often referred to as cross-tees and being engaged with two adjacent longitudinal runners at each end.

Although such suspended ceilings were satisfactory to a certain degree, the rigid inversed-T shape of the runners made them particularly difficult to arrange for shipping, and any resulting shipping configuration typically resulted in a relatively high amount of lost volume. This drawback is considerable considering that shipping costs are an important factor in the overall costs of runners and cross-tees. In another aspect, the runners were manufactured in given standard lengths, which often required longitudinally assembling two or more runners end to end. Also, runners were traditionally suspended using wire, which was time-consuming. Accordingly, there remained room for improvement.

SUMMARY

In accordance with one aspect, there is provided a runner for a suspended ceiling where the web is foldable relative to a base. For instance, it can be hingedly connected between the two flanges. The web can thus be folded against the base into a flat configuration for shipping, and unfolded to be normal to the base during installation and use.

The runner can be manufactured in traditional given lengths for example, in which case the folded runners can be stacked into an efficient configuration. The runners can be made of somewhat flexible or rigid materials. If sufficiently flexible, folded runners having a much longer length than those traditionally made available can be coiled. A runner coil can be installed by affixing one end to a first wall, unrolling a length of runner corresponding to the distance between the first wall and a second opposite wall, cutting the runner at that length, unfolding the web and suspending it and affixing the cut end to the second wall. This can reduce the inconveniences which were related to joining runners end to end, for instance.

In accordance with another aspect, there is thus provided a runner for suspended ceiling provided in the form of a coil.

In accordance with another aspect, there is provided a runner for suspended ceilings, the runner being elongated in shape, having a base with two laterally opposite flanges for supporting ceiling tiles and a web hingedly connected to the base between the flanges so as to be foldable between a flat configuration with the web folded against one of the flanges, and an inversed-T configuration with the web normal to the base for suspension and use.

In accordance with another aspect, there is provided a suspended ceiling system having a plurality of runners, each one of the runners having a base with two laterally opposite flanges for supporting ceiling tiles and a web hingedly connected to the base between the flanges.

In accordance with another aspect, there is provided a method of installing a suspended ceiling comprising unfolding a runner having a web hingedly mounted to a base from a folded configuration where the web is folded against the base, to an unfolded configuration where the web is normal to the base.

In accordance with another aspect, there is provided a runner for suspended ceiling having an inversed-T shape during use, with a web connected along the length of a base, between two laterally opposite flanges of the base, the runner being characterized in that the web is hingedly connected to the base so as to be foldable between a flat shape with the web folded against one of the flanges, and the inversed-T shape with the web normal to the base.

In accordance with another aspect, there is provided a method of suspending runners of a suspended ceiling system with cable fasteners, each cable fastener being elongated, having a proximal end and a distal end, and having at least one hook at the proximal end, the runners each having a plurality of apertures interspaced along its length, each one of the apertures having a catch matching the hook of the cable fasteners for snapping locking engagement, the method comprising inserting the proximal end of a cable fastener in a selected one of the apertures thereby lockingly engaging the hook with the selected aperture, and affixing the distal end of the cable fastener to a building structure.

In accordance with another aspect, there is provided a suspended ceiling system comprising in combination runners and cable fasteners, each cable fastener being elongated, having a proximal end and a distal end, and having at least one hook at the proximal end, the runners each having a plurality of apertures interspaced along its length, each one of the apertures having a catch matching the hook of the cable fasteners for snapping locking engagement therewith when the proximal is inserted into a selected one of the apertures.

DESCRIPTION OF THE FIGURES

In the figures.

DETAILED DESCRIPTION

Figure 1A:
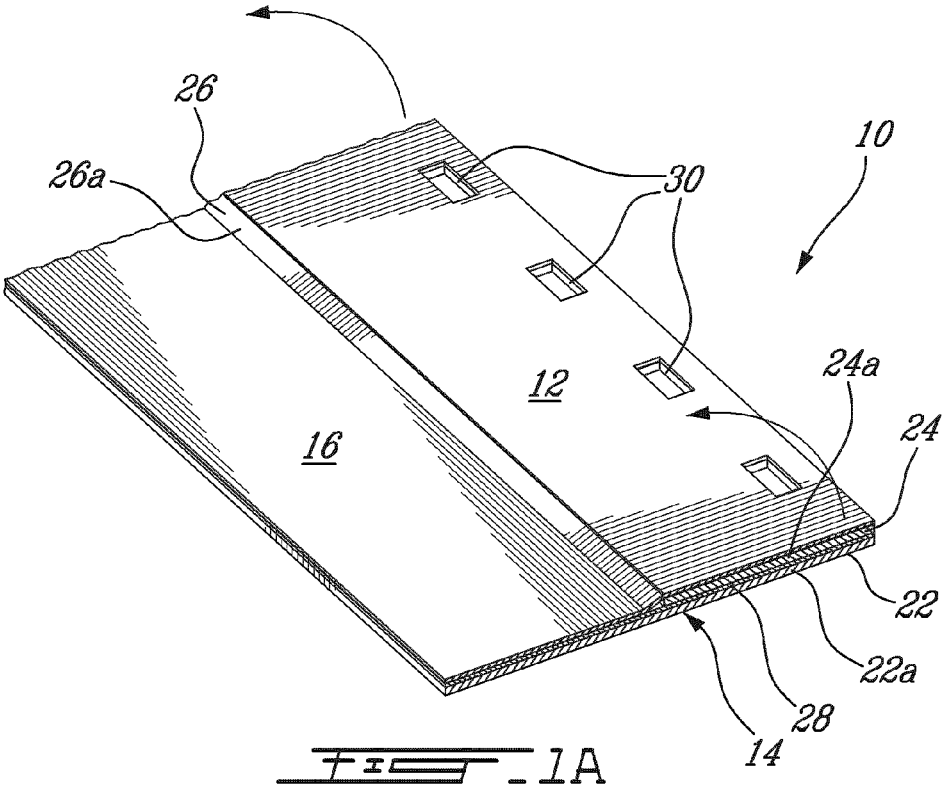
FIG. 1 includes FIG. 1A and FIG. 1B, which are perspective views showing an end portion of an example of a runner, folded and unfolded, respectively.
Figure 1B:
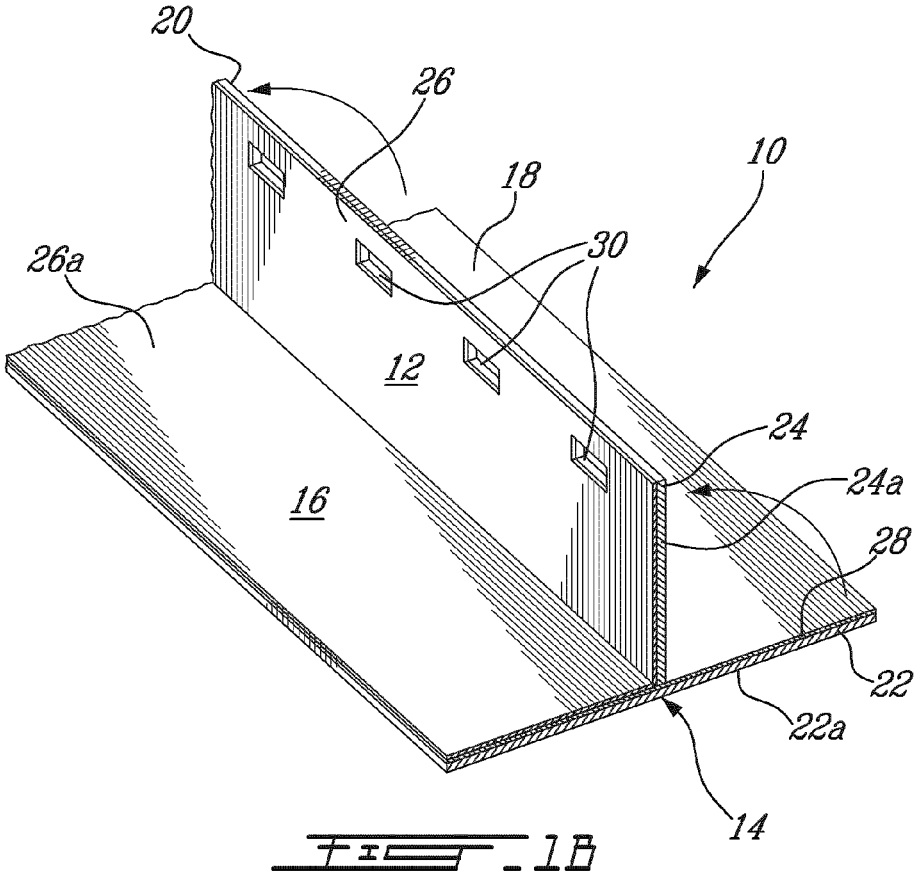

FIGS. 1A and 1B show an example of a runner 10 for suspended ceilings. Generally, the runner 10 can be seen to have a web 12 and a base 14, the web 12 being hingedly connected to the base 14 between two lateral flanges 16, 18 thereof. The flanges 16, 18 are to receive and support ceiling tiles (not shown) during installation. More specifically, the web 12 is hingedly connected in the sense that it can be folded between a flat configuration shown in FIG. 1A, for shipping, where a face 20 thereof is placed into abutment against one of the flanges 18, and an inversed-T configuration shown in FIG. 1B where the web 12 is positioned substantially normal to the base 14, for use in a suspended ceiling grid.

Figure 6:
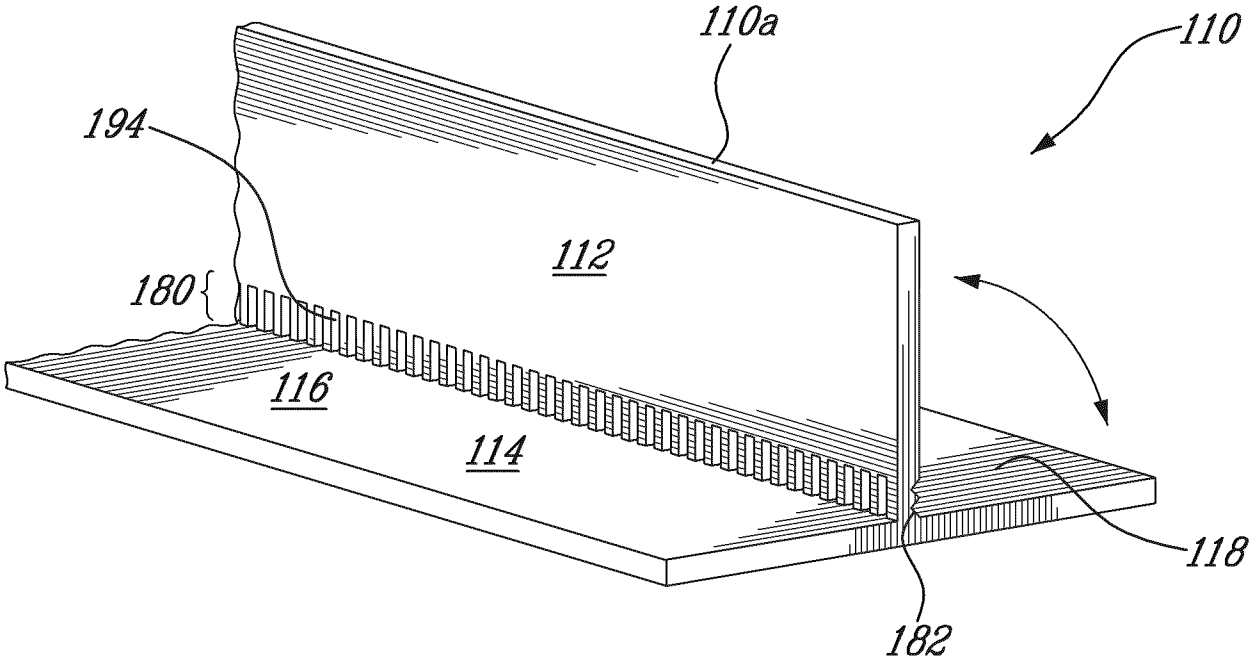
FIG. 6 is a perspective view showing an end portion of another example of a runner.

As it will appear from the description provided herein, there are various ways of making a runner having the aforementioned characteristics. Henceforth, it will be understood that the thorough description of the example shown in FIG. 1, and later of the example shown in FIG. 6, are provided solely as a detailed descriptions of two appreciated embodiments, and the specificities thereof are by no way intended to limit the scope of this specification.

In the example shown in FIG. 1, the web 12 and the base 14 have separate components 22, 24. More particularly, the base 14 can be seen to have a base structural layer 22, and the web can be seen to have a web structural layer 24. The base structural layer 22 and web structural layer 24 can be made from a sheet material such as metal, plastic (including plastics which include a substantial portion of wood particles) or elastomeric materials, or wood such as a wood veneer for example. In this embodiment, the web structural layer 24 is hingedly connected to the base structural layer 22 by way of a flexible sheet layer 26 which can at least partially cover and be adhered to one of the flanges 16 of the base 14, and one of the faces of the web structural layer 24. This flexible sheet layer 26 can be a paper, a film, a mesh, a foil, a tape, or any suitable material. It can be continuous or discontinuous.

If the material of the base structural layer 22 and the web structural layer 24 is sufficiently flexible, the runner 10, with the web 12 folded in the flat configuration shown in FIG. 1A, can be coiled if desired, which allows its manufacture in greater lengths. Alternately, the runner 10 can be provided in any desired set length for example.

Many plastic materials can have sufficient flexibility for providing the runner 10 in a coil. Alternately, it was found that some wood materials can be made sufficiently flexible by adhering a flexible sheet layer, sometimes referred to as a support layer, to the particular wood material. The particular example illustrated in FIGS. 1A and 1B, for instance, show a runner having wood layer 22*a*, 24*a* (which can be made from a wood veneer for instance, of which 1/34 inch thickness has been found suitable to provide one example—greater and lesser thicknesses can be used as well) both in the web 12 and the base 14. The wood layer 22*a* of the base 14 is entirely covered by a first flexible sheet layer 28 (Kraft paper in this case) which is adhered to the wood layer 22*a* of the base. The wood layer 24*a* of the web 12 is laid onto the first flexible sheet layer 28 of the base, more particularly on one of the flanges 18 thereof, and a second flexible sheet layer 26*a* (also Kraft paper in this case) is adhered to cover both the other one of the flanges 16 of the base 14, and the exposed face of the wood layer 24*a* of the web 12. It will be noted here that the flexible sheet layers 28, 26*a* can be made of any suitable material.

In the embodiment illustrated in FIGS. 1A and 1B, a series of regularly longitudinally interspaced apertures 30 are provided in a side (toward an edge) of the web 12 which is away from the connection to the base 14. These apertures 30 can be used to pass a tie (not shown) therethrough and to suspend the runner 10 by its web 12 to a structure of the building where the suspended ceiling is mounted (not shown).

A configuration such as described above can be manufactured on-line, with different layers and adhesive applied onto one another via rolls and a rotary punch can be used to create the regularly spaced apertures, for instance. Alternately, such a configuration can also be manufactured off-line.

Figure 2:
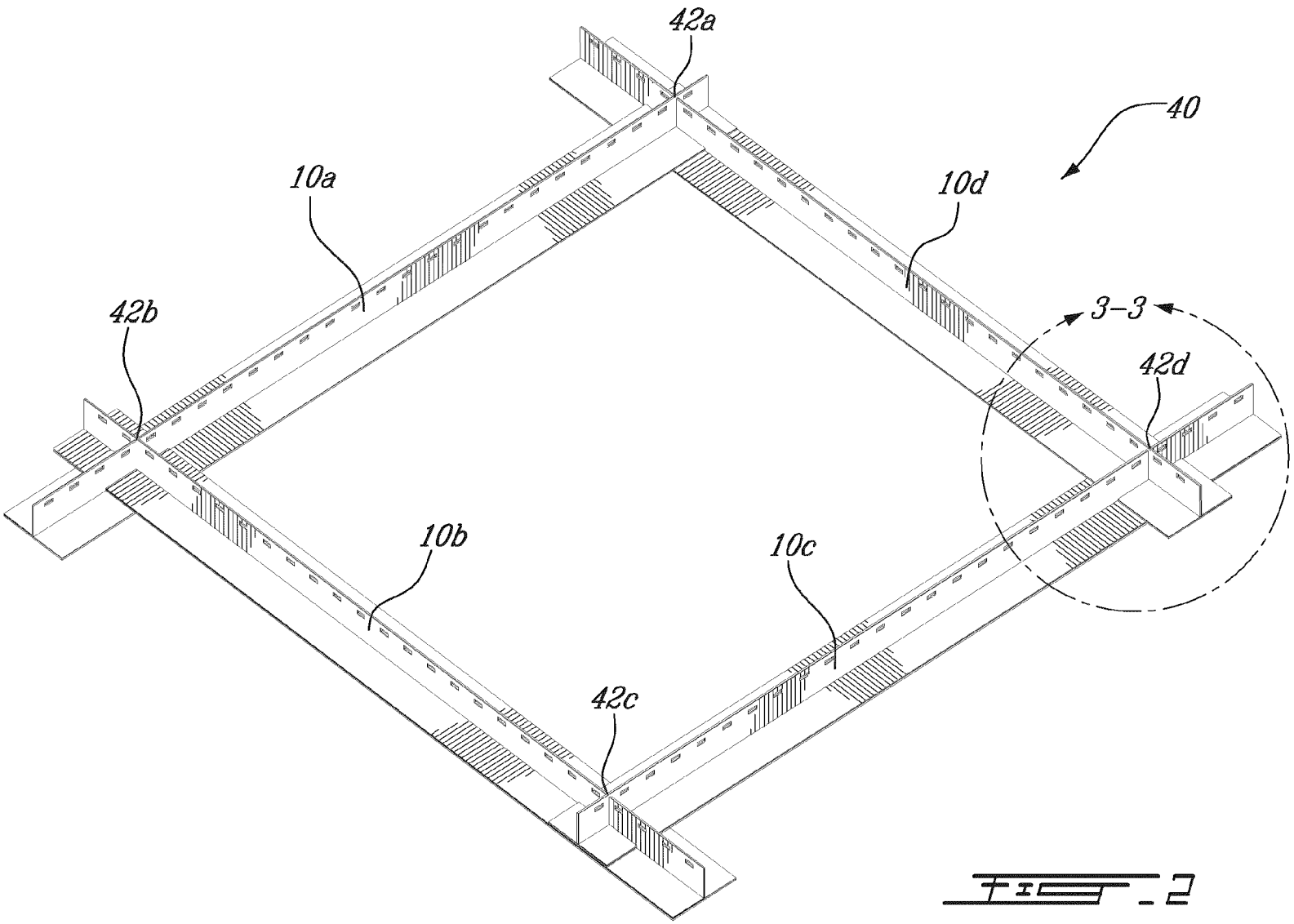
FIG. 2 is a perspective view showing a portion of a suspended ceiling system with runners arranged in a grid configuration.

Turning to FIG. 2, an example portion of suspended ceiling system 40 is shown. In this example, a suspended grid configuration of runners 10*a*, 10*b*, 10*c*, 10*d* of the suspended ceiling system 40 is shown assembled and ready for supporting suspended ceiling tiles (not shown). The grid can include a plurality of longitudinal runners (10*b*, 10*d*) which are parallel to and regularly interspaced from one another. The grid can also include a plurality of transverse runners (10*a*, 10*c*) which are parallel to and regularly interspaced from one another. The areas of the grid which correspond to both transverse runners and longitudinal runners can be referred to as intersections 42*a*, 42*b*, 42*c*, 42*d*. It will be understood here that any one of the transverse runners and longitudinal runners can include a number of runners in an end-to-end configuration.

There are many ways to join runners at the intersections, and the particular way chosen in a particular installation will likely depend of the material(s) of which the runners are made of and of their lengths. Traditionally, it was known to use cross-tees having a length corresponding to the distance between two longitudinal runners, and having ends configured to attach thereto, as transverse runners. This latter way is still possible, along with other variants.

Figure 3:
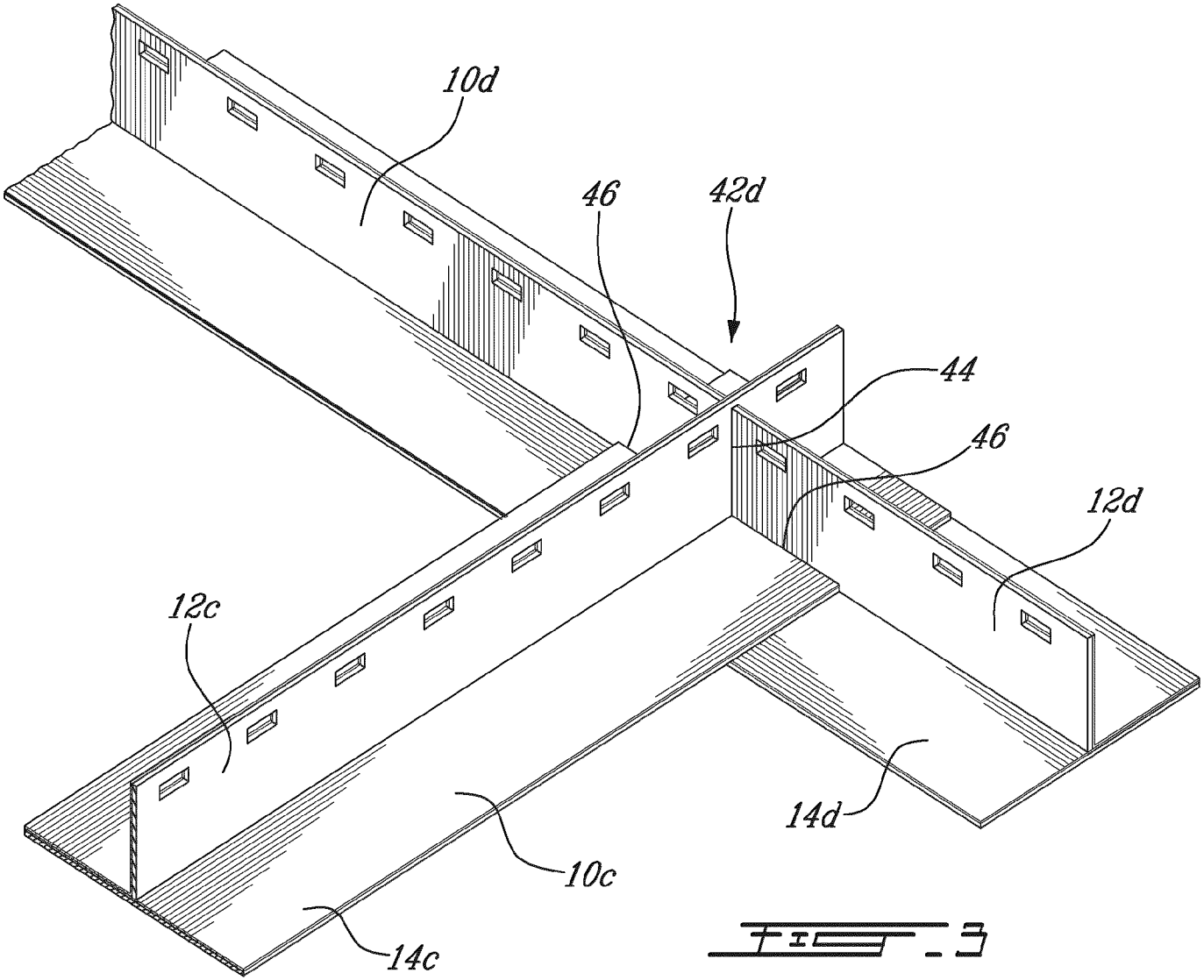
FIG. 3 is an enlarged view of a portion of FIG. 2.

For illustrative purposes, in the particular example given in FIGS. 2 and 3, the runners 10*a*, 10*b*, 10*c*, 10*d* can be made of a cuttable or slittable material. Henceforth, taking intersection 42*d* as an example and referring to FIG. 3, the web 12*d* of the runner 10*d* can have a transversal (vertical) slit 44, and a longitudinal slit 46 adjacent the base 14*d*, and an intersecting runner 10*c* can be driven through the slits 44, 46, such as shown more clearly on the enlarged view of FIG. 3. In this manner, the intersecting runner 10*c* can be said to penetrate the web 12 of the runner 10*d* and to be supported by the base 12*d* of the runner 10*d* it intersects.

Referring back to FIG. 2, it can be seen that the intersecting runner (i.e. the one of the runners which penetrates the other) can be either a longitudinal runner 10*b*, 10*d* or a transverse runner 10*a*, 10*c*. Moreover, in the particular grid configuration illustrated in FIG. 2, the configuration is such that, at successive intersections along any one of the longitudinal runners 10*b*, 10*d* and the transverse runners 10*a*, 10*c*, an alternating one of a transverse runner and a longitudinal runner penetrates through the web of the other one of a transverse runner and a longitudinal runner. This particular configuration can be useful to strengthen the runners 10*a*, 10*b*, 10*c*, 10*d* and maintain the base thereof from rotation, to help them support uneven forces from the tiles which can occur during assembly, given the fact that the base is hinged relative to the web—e.g., referring to FIG. 3, the base 14*c* of the intersecting runner 10*c* is prevented from rotating by the transversally-oriented base 14*d* of the intersected runner 10*d*. This alternating configuration results in that at any given tile area such as the one shown in FIG. 3, each one of the four surrounding runners 10*a* to 10*d* is prevented from rotating at one intersection, further, each one of the four surrounding runners 10*a* to

10*d* intersects another one of the runners at one intersection and is intersected by another one of the runners at the other intersection. This also contributes to spread the load of the tiles on the supporting grid. It will be noted here that the slits 44, 46 (FIG. 3) can be made online with rotary blades, or be made with snips or the like at the time of assembly, for example. If the material of the runner has sufficient flexibility and the runners are made of a sufficiently thin material, the edges of the web 12*d* adjacent the slit 44 can be bent to allow insertion of the intersecting runner 10*d* and subsequently released and replaced into position to lock the intersecting runner 10*d* into place.

It will be understood that the grid configuration shown in FIG. 2 is specifically adapted for receiving square tiles. Alternately, it can be configured for receiving rectangular tiles, or tiles of another regular tetragon shape, for instance.

Figure 4:
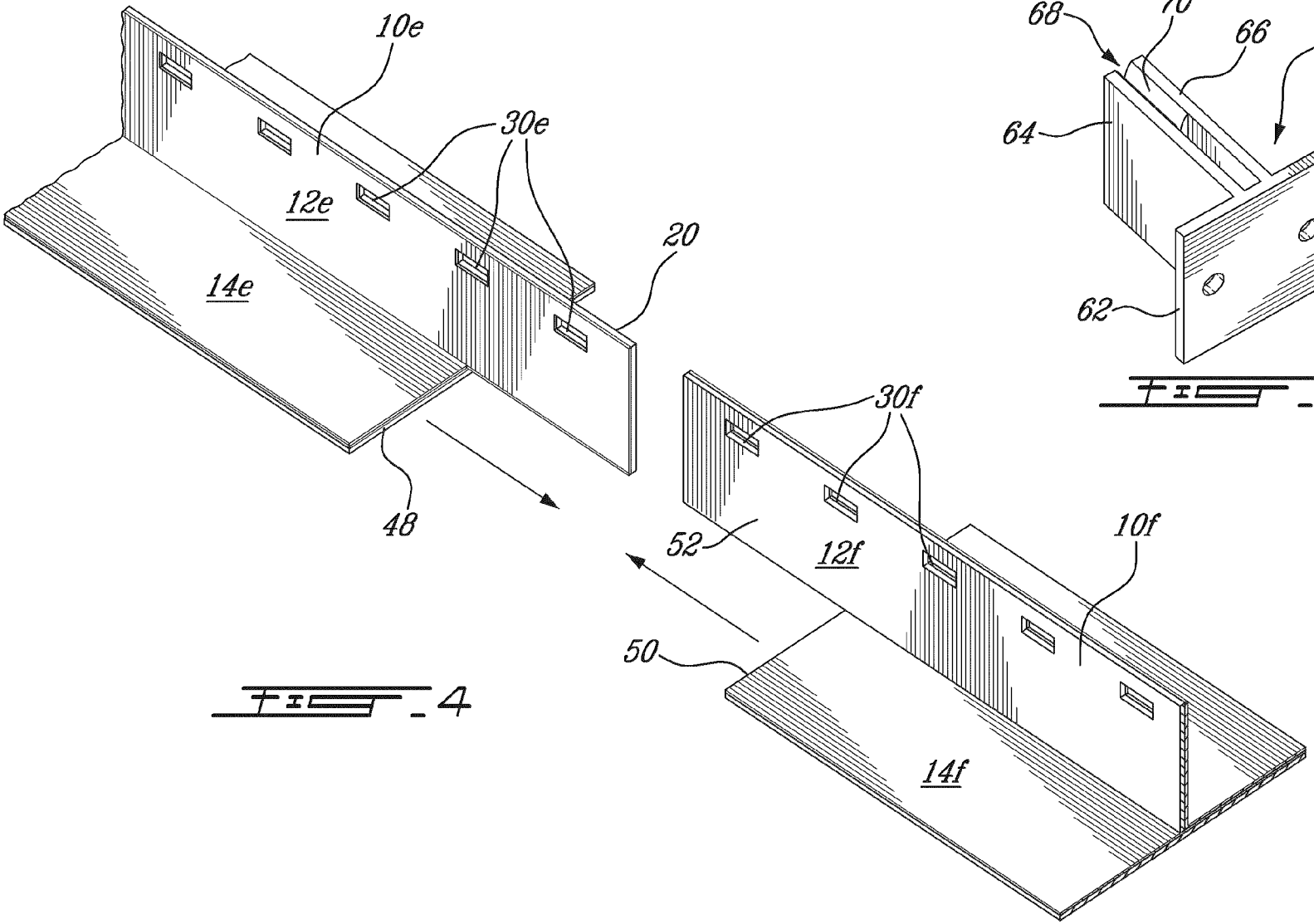
FIG. 4 is a perspective view showing the assembly of two runners end to end.

There are different ways to join runners end-to-end if desired. One way to do so is illustrated in FIG. 4. In this example, a given length of base 14*e*, 14*f* of two runners 10*e*, 10*f* are removed at the ends which are to be joined, and the shortened ends 48, 50 of the two bases 14*e*, 14*f* are placed in abutment against each other in the direction of the arrows, with the webs 12*e*, 12*f* being placed side by side, with one face 20 of one web 12*e* being positioned against one face 52 of the other web 12*f*. The webs 12*e*, 12*f* can then be joined to one another by adhesion or fastening for instance. Alternately, the length of cutting of the bases and the configuration of the suspension apertures can be selected for two or more apertures 30*e*, 30*f* of the two webs 12*e*, 12*f* to coincide when the runners 10*e*, 10*f* are joined end to end, in a manner that passing a tie through the coinciding apertures 30*e*, 30*f* can serve in joining the webs to one another.

Along the walls, moldings (not shown) can be provided and affixed to the walls to support the edges of the tiles which are adjacent to the walls. Further, wall brackets can be used above the moldings to secure ends of the runners against the wall.

Figure 5:
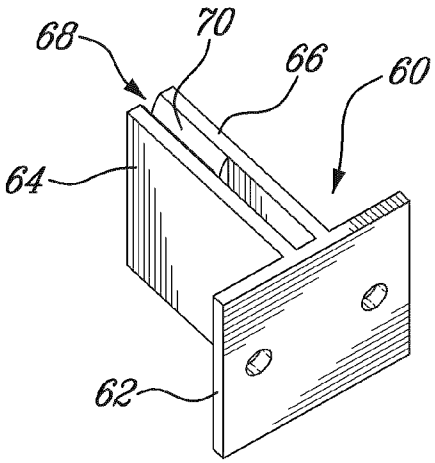
FIG. 5 is a perspective view showing a wall bracket for holding a runner against a wall.

An example of such a wall bracket 60 is shown in FIG. 5. The illustrated wall bracket has a base 62 for fixing to a wall, and two fingers 64, 66 defining an open-ended slot 68 into which a web 12 portion at an end of the runner 10 (see FIG. 1B) can be inserted. The base 12 of the runner 10 can be supported vertically by the molding, while the fingers 64, 66 hold the runner 10 transversally. The wall bracket 60 can have an internal hook member 70 to snap with an aperture 30 in the web 12 and thereby hold the runner 10 longitudinally to ease installation. In the particular embodiment illustrated, the internal hook member 70 of the wall bracket 60 is particularly shaped and configured to engage with a corresponding suspension aperture 30 of the runner 10.

Referring now to FIG. 6, another example of a runner 110 is shown. In this example, the runner 110 is made of a single component 110*a* and the web 112 and base 114 are integral. Such a runner 110 can be made by extrusion, for instance. It can be made of any suitable material. Plastic can be used for instance, including plastics which have a relatively high amount of wood particles mixed there into, to give a wooden aspect to the runner for instance.

Generally, the runner 110 illustrated in FIG. 6 also has a web 112 which is hingedly connected to the base 114, between two flanges 116, 118 of the base 114. A flexible portion 180 extending longitudinally adjacent the base 114 allows this hinged connection. More particularly, in this particular example, the hinged connection is created by making the flexible portion 180 thinner than the remainder of the web, and even more particularly by defining a longitudinally oriented w-shaped notch 182 therein. In an alternate embodiment, for example, the flexible portion 180 can be made flexible by using in that area a material which is more flexible than in the remainder of the runner 110, to give another example.

If desired, a runner 110 such as shown in FIG. 6 can be provided in given lengths, corresponding to dimensions of the tiles to be used, and the given length runners can be assembled end to end and with transversally oriented ones. One way to assemble runner ends to one another is to use connectors.

Figure 7:
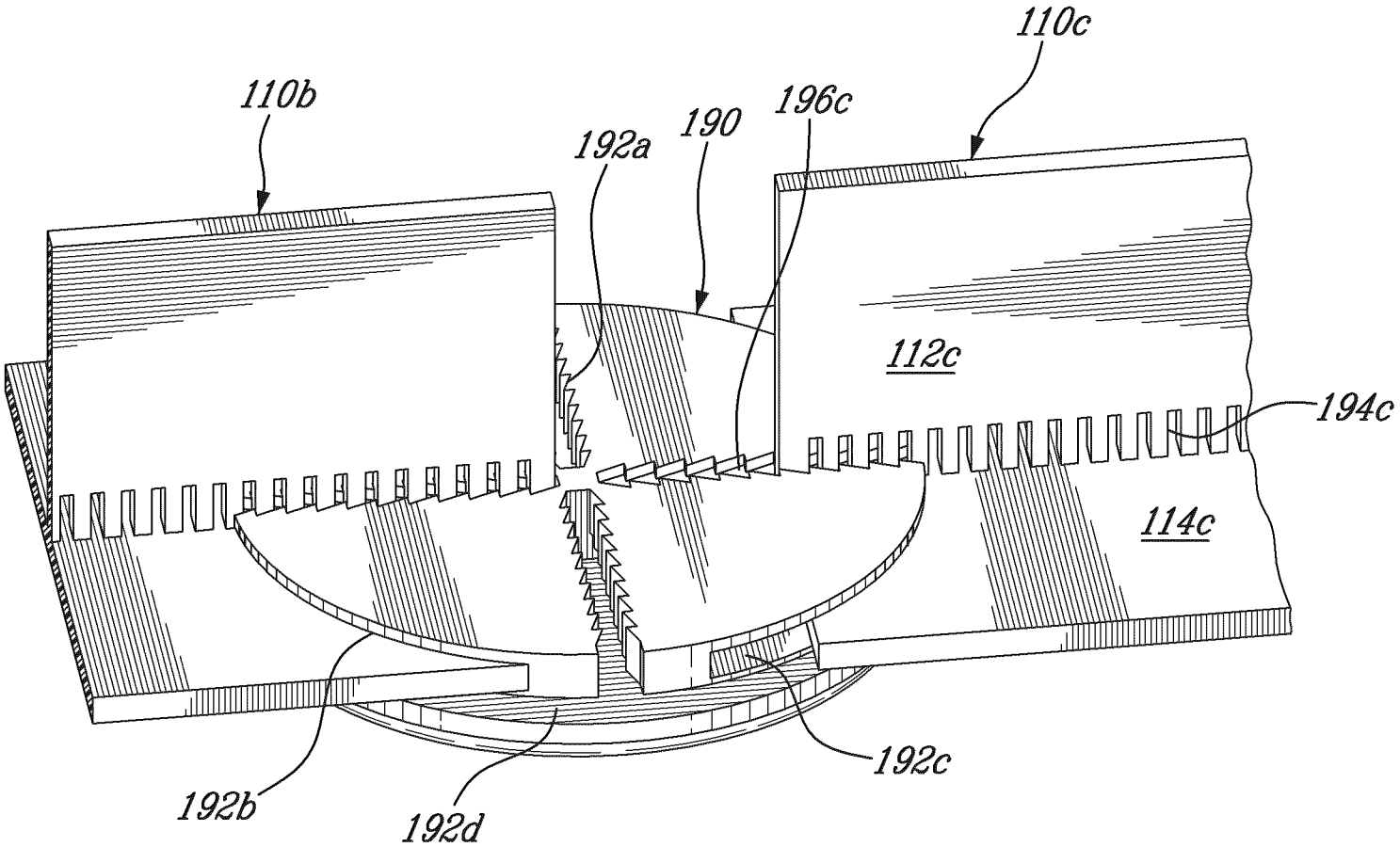
FIG. 7 is a perspective view showing the assembly of two runners of FIG. 6 in an end to end configuration.

An example of a connector 190 is shown in FIG. 7. This connector has four runner sockets 192*a*, 192*b*, 192*c*, 192*d* defined therein, oriented at 90° from one another, and configured in a manner that the runners 110*b*, 110*c* can be firmly received therein to form end-to-end junctions and/or intersections. It can be practical that the runners and connectors in such embodiments be designed in a manner that the runner be firmly held in the runner socket once inserted. In the illustrated embodiment, this is achieved by using a crenate rack at least the ends of the runners and/or the inside faces of the runner sockets, and to have at least one of these act as a pawl in ratchet action configuration to prevent retraction of the runner from the runner socket once it has been fully inserted. In the particular embodiment illustrated, this is achieved by a crenate rack 194*c* provided along one side of the web 112*c*, adjacent the base 114*c* and having a crenellated shape, and crenate rack 196*c* with slanted teeth having a pawl action against the crenellated shape of the crenate rack 194*c*, defined in the runner socket 192*c*, although it will be understood that variants are also possible and that the pawl and rack can be inversed. In other words, the crenate rack 196*c* of the runner socket 192*c* is designed to form a linear ratchet with the crenate rack 194*c* of the runner 110*c*.

Figure 8:
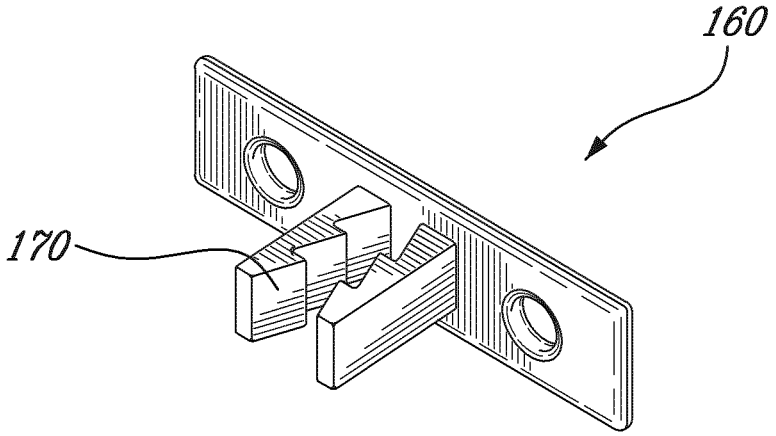
FIG. 8 is a perspective view showing a wall bracket for holding a runner of FIG. 6 against the wall.

Now turning to FIG. 8, a particular wall bracket which is designed specifically to hold an end of a runner 110 shown in FIG. 6 against a wall in a ratchet action by having ratchet pawl hooks 170 defined therein and adapted to lockingly engage the crenellated shape of the runner crenate rack 196.

It will be understood that the dimensions of the crenate racks 194*c* and 196*c*, and of ratchet pawl hooks 170 can vary depending on the elasticity of the material used, for instance.

Figure 9:
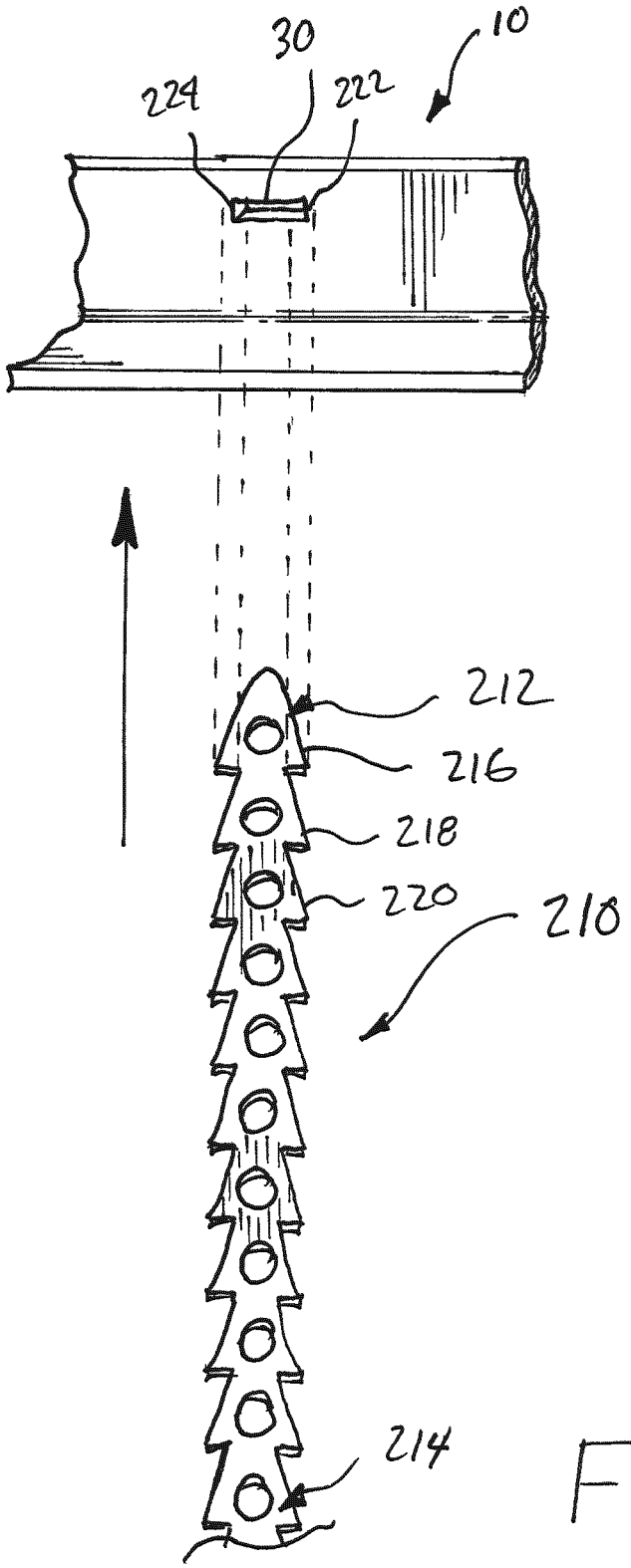
FIG. 9 is a perspective view showing a cable attachment for insertion in an aperture of a runner and suspending the runner.

Turning now to FIG. 9, an example of how runners 10 can be suspended from a building structure is shown. In this example, the runner 10 is suspended using a cable fastener 210. The cable fastener 210 is elongated and has a proximal end 212 and a distal end 214. The proximal end has at least one hook 216 which is designed to snap into locking engagement with the aperture 30 of the runner 10 once the proximal end has been inserted through the aperture 30. In this particular example, the cable fastener 210 has a plurality of hooks 216, 218, 220 (. . . ) positioned at a regular spacing from each other beginning at the proximal end 212. The hooks 216, 218, 220 thus form a gear rack on the cable fastener. The aperture 30 is shaped to mate with the cable fastener 210, and more particularly for corresponding edges thereof 222, 224 to act as a catch in which the hook 216 lockingly engages. In embodiments having a plurality of hooks forming a gear rack, the catch can mate with the gear rack to act as a ratchet when the gear rack is moved through the aperture 30, thereby preventing retraction of the proximal end 212 from the aperture 30 once passed any one of the successive hooks. In this example, this mating engagement is achieved with a cable fastener 210 which is flat, with hooks which are provided as hook pairs extending from both edges of the flat cable fastener, and an aperture 30 which is rectangular in shape which has a thickness sufficiently small to force the hook pairs against the edges 222, 224 although the cable fastener actually forms an interference fit with the aperture 30; the cable fastener and/or runner 10 being somewhat resilient for the hook to snap when passing each of the successive hook pairs. Alternate embodiments are possible.

The use of a cable fastener such as described above can dramatically increase the speed of installing runners as compared to former methods using wire. Wire needs to be cut to length, and twisted, which is time consuming. Using a combination of a cable fastener with a runner which has a specifically designed aperture to catch with the cable fastener can be significantly faster. Suspending a runner can be as simple as inserting a proximal end of the cable fastener into the aperture, thereby engaging a hook of the cable fastener with a catch in the aperture. Afterwards, the cable fastener is prevented from being retracted by the hook. The distal end of the cable fastener can be attached to a building structure. The distal end of the cable fastener can be attached before or after having inserted the proximal end through the aperture. If using a cable fastener having a plurality of hooks in a gear rack configuration, the distal end of the cable fastener can be attached to the building structure first, for instance, and the proximal end can be moved through the aperture up to a selected one of the successive hooks conveniently corresponding to a given suspension height.

It will be understood that a cable fastener as described above can be used to suspend runners such as described above, but can also be used to suspend rigid runners, for instance.

It is repeated here that the embodiments described above are provided only as examples and are not intended to restrict the scope of this specification. For instance the suspension apertures are optional, their configuration can be different, and they can have different shapes; the runners can be suspended in any suitable manner, including with wire for instance; the hinged connection can be continuous or discontinuous; the structural layers of the web and/or the base can have more than one layers laminated atop one another, optionally with different materials; the web and the base can have any suitable different relative dimensions, etc.

The scope is indicated by the appended claims.

What is claimed is:

1. A suspended ceiling system having a plurality of runners, each one of the runners having a base with two laterally opposite flanges for supporting ceiling tiles and a web hingedly connected to the base between the flanges, wherein the runners are suspended to a building structure in a grid configuration, with a plurality of parallel and equally interspaced longitudinal runners and a plurality of parallel and equally interspaced transverse runners and an array of intersections therebetween further comprising a plurality of runner connectors, wherein at each one of the intersections, one of the runner connectors lockingly receives the ends of two aligned ones of the longitudinal runners and two aligned ones of the transverse runners.

2. A suspended ceiling system having a plurality of runners, each one of the runners having a base with two laterally opposite flanges for supporting ceiling tiles and a web hingedly connected to the base between the flanges, further comprising a plurality of runner connectors, each one of the runner connectors having four runner sockets, oriented at 90° from one another.

3. The suspended ceiling system of claim 2 wherein the web has a longitudinally extending crenate rack adjacent the base, at least at opposite ends thereof, and each one of the runner sockets also has a crenate rack shaped to mate with the crenate rack of the web in a ratchet configuration which prevents retraction of the runners once they have been inserted into runner sockets.

4. A method of installing a suspended ceiling comprising unfolding a runner having a web hingedly mounted to a base from a folded configuration where the web is folded against the base, to an unfolded configuration where the web is normal to the base, further comprising affixing an end of the runner to a wall.

* * * * *